US011306714B2

(12) United States Patent
Yokoi

(10) Patent No.: US 11,306,714 B2
(45) Date of Patent: Apr. 19, 2022

(54) LIQUID FEEDING PUMP OPERATION MONITOR

(71) Applicant: SHIMADZU CORPORATION, Kyoto (JP)

(72) Inventor: Yusuke Yokoi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 131 days.

(21) Appl. No.: 16/606,743

(22) PCT Filed: May 16, 2017

(86) PCT No.: PCT/JP2017/018303
§ 371 (c)(1),
(2) Date: Oct. 19, 2019

(87) PCT Pub. No.: WO2018/211584
PCT Pub. Date: Nov. 22, 2018

(65) Prior Publication Data
US 2020/0056606 A1 Feb. 20, 2020

(51) Int. Cl.

| | |
|---|---|
| ***F04B 51/00*** | (2006.01) |
| ***F04B 13/00*** | (2006.01) |
| ***F04B 23/02*** | (2006.01) |
| ***F04B 49/06*** | (2006.01) |
| ***F04B 49/10*** | (2006.01) |
| ***F04B 23/04*** | (2006.01) |

(52) U.S. Cl.
CPC ..... *F04B 51/00* (2013.01); *F04B 13/00* (2013.01); *F04B 23/02* (2013.01); *F04B 23/04* (2013.01); *F04B 49/065* (2013.01); *F04B 49/106* (2013.01); *F04B 2205/09* (2013.01)

(58) Field of Classification Search
CPC ..... F04B 23/02; F04B 23/04; F04B 13/00; F04B 19/065; F04B 19/106; F04B 51/00; F04B 2205/06; F04B 49/065; F04B 49/106
USPC ..... 417/36–41
See application file for complete search history.

(56) References Cited

U.S. PATENT DOCUMENTS

2003/0129327 A1 7/2003 Shibue
2015/0210180 A1 7/2015 Hua
(Continued)

FOREIGN PATENT DOCUMENTS

CN 201853140 U 6/2011
CN 104126245 A 10/2014
CN 204783597 U 11/2015
(Continued)

OTHER PUBLICATIONS

Office Action for corresponding Japanese Patent Application No. 2019-518629, dated Oct. 12, 2020, with English translation.
Decision of Rejection for corresponding Taiwanese Patent Application No. 10920988030, dated Oct. 15, 2020, with English translation.
(Continued)

*Primary Examiner* — Charles G Freay
(74) *Attorney, Agent, or Firm* — Renner, Otto, Boisselle & Sklar, LLP

(57) ABSTRACT

A liquid feeding pump operation monitor includes: a liquid gauge that measures a remaining amount of a liquid to be fed by a liquid feeding pump; and an operation detector configured to detect a reduction of the remaining amount, which is measured by the liquid gauge, of the liquid to be fed, and to detect an operation of the liquid feeding pump based on the detection of the reduction.

8 Claims, 5 Drawing Sheets

(56) References Cited

U.S. PATENT DOCUMENTS

| | | | | |
|---|---|---|---|---|
| 2017/0008784 | A1 | 1/2017 | Shimpo | |
| 2018/0052140 | A1* | 2/2018 | Yokoi | G01N 35/00 |

FOREIGN PATENT DOCUMENTS

| | | | |
|---|---|---|---|
| JP | H03-016534 | A | 1/1991 |
| JP | 8-247042 | A | 9/1996 |
| JP | 11-23557 | A | 1/1999 |
| JP | 2004-070424 | A | 3/2004 |
| JP | 2006313093 | A | 11/2006 |
| JP | 2010-242730 | A | 10/2010 |
| JP | 2015059895 | A | 3/2015 |
| JP | 2015-224815 | A | 12/2015 |
| TW | 200806451 | A | 2/2008 |

OTHER PUBLICATIONS

Office Action for corresponding China Patent Application No. 201780090544.3, dated Apr. 17, 2020.
Third Office Action for corresponding Taiwan Patent Application No. 107115469, dated Feb. 21, 2020.
Office Action for corresponding Japanese Patent Application No. 2019-518629, dated Jun. 8, 2020, with English translation.
International Search Report for corresponding International Application No. PCT/JP2017/018303, dated Aug. 8, 2017.
Written Opinion for corresponding International Application No. PCT/JP2017/018303, dated Aug. 8, 2017.
First Office Action for corresponding Taiwan Patent Application No. 107115469, dated Nov. 9, 2018.
Second Office Action for corresponding Taiwan Patent Application No. 107115469, dated Jun. 17, 2019.

* cited by examiner

LIQUID FEEDING PUMP OPERATION MONITOR

TECHNICAL FIELD

The present invention relates to a liquid feeding pump operation monitor for monitoring an operating status of a liquid feeding pump that is used in an analysis device such as a liquid chromatograph.

BACKGROUND ART

In an analysis device that performs analysis while allowing a liquid to flow, such as a liquid chromatograph, a liquid feeding pump is a consumable item that deteriorates with operating time together with essential components. In the liquid feeding pump, there is a seal part that deteriorates with the operating time of the liquid feeding pump due to sliding during operation. For example, a plunger pump uses a ring-shaped resin seal called a plunger seal to prevent liquid leakage from a pump chamber, but the plunger seal always slides against the outer peripheral surface of a plunger during the operation of the liquid feeding pump, and thus deteriorates due to accumulation of operating time. When the plunger seal deteriorates, liquid leakage from the pump chamber is likely to occur, and the liquid feeding accuracy is lowered, causing a reduction in analysis accuracy. It is thus necessary to perform maintenance work on the liquid feeding pump, such as replacement of the seal part, at an appropriate time.

In order to grasp the appropriate timing for performing the maintenance work on the liquid feeding pump, it is necessary to monitor the operating status of the liquid feeding pump. As a method for monitoring the operating status of the apparatus, there is a method in which power consumption of the apparatus is measured, and the power consumption is compared with a preset determination criterion to determine whether or not the apparatus is in operation (e.g., see Patent Document 1).

PRIOR ART DOCUMENT

Patent Document

Patent Document 1: Japanese Patent No. 2004-070424

SUMMARY OF THE INVENTION

Problems to be Solved by the Invention

Generally, a liquid feeding pump, a management device for managing the operation of the liquid feeding pump, and the like are equipped with functions of monitoring the operating status of the liquid feeding pump, such as the operating rate thereof and whether or not the liquid feeding pump is in operation, and the information concerning the operating status of the liquid feeding pump is managed by the management device and a data server.

However, liquid feeding pumps have been manufactured by a plurality of manufacturers, and the management device and the data server for managing the operating status of the liquid feeding pump exist for each manufacturer. Therefore, when a user constructs an analysis system using liquid feeding pumps from a plurality of manufacturers, the operating statuses of the respective liquid feeding pumps are spread across the plurality of management devices and data servers, making unified management difficult.

As in Patent Document 1, when the operating statuses of the plurality of liquid feeding pumps are to be monitored by measuring the power consumption, it is necessary to attach a power consumption measuring device to each liquid feeding pump and set a determination criterion for each liquid feeding pump, which may cause problems of an increase in installation cost and complications of the installation work and the setting work. In addition, depending on the type of the liquid feeding pump, the power consumption may hardly change in the operation state, and it may not be possible to determine whether or not the liquid feeding pump is in operation based on the power consumption.

The present invention has been made in view of the above problems, and an object of the present invention is to make it possible to easily monitor an operating status of a liquid feeding pump regardless of the manufacturer of the liquid feeding pump.

Solutions to the Problems

A liquid feeding pump operation monitor according to the present invention includes: a liquid gauge that measures a remaining amount of a liquid to be fed by a liquid feeding pump; and an operation detector configured to detect a reduction of the remaining amount, which is measured by the liquid gauge, of the liquid to be fed, and to detect an operation of the liquid feeding pump based on the detection of the reduction.

In the liquid feeding pump operation monitor according to the present invention, it is preferable to further include an operating time calculator that adds up a time during which the operation of the liquid feeding pump is detected by the operation detector to calculate an operating time of the liquid feeding pump. Then, the operating time of the liquid feeding pump can be monitored, and the grasping of the maintenance time for the liquid feeding pump and the like are facilitated.

Moreover, it is preferable to further include: a power-on time calculator configured to add up a time during which the liquid feeding pump is on; and an operating rate calculator configured to calculate an operating rate of the liquid feeding pump based on the operating time calculated by the operating time calculator and the power-on time calculated by the power-on time calculator. Then, a user can know the operating rate of the liquid feeding pump. Being able to know the operating rate of the liquid feeding pump makes it possible to predict the transition of the operating time of the liquid feeding pump based on a usage status of an analysis device.

In a preferred embodiment, the operation detector is configured to calculate a changing rate in the remaining amount, which is measured by the liquid gauge, of the liquid to be fed, and to detect that the liquid feeding pump is in operation when the changing rate is equal to or less than a predetermined value. The predetermined value is, for example, a value of 0 or less and is a preset threshold. The predetermined value may be a fixed value or a value set by the user in a freely selectable manner.

An example of the liquid gauge is to measure a weight of a container in which the liquid to be fed is stored. An example of such a liquid gauge includes one using an electronic balance.

Further, another example of the liquid gauge is to measure a liquid level of the liquid to be fed. Examples of such a liquid gauge include one using a contactless liquid-level sensor.

Effects of the Invention

In the liquid feeding pump operation monitor according to the present invention, whether or not the liquid feeding pump is in operation is detected based not on information from the liquid feeding pump itself such as power consumption, but on information from the liquid gauge which is the remaining amount of the liquid to be fed by the liquid feeding pump, so that it is possible to easily detect whether or not the liquid feeding pump is in operation regardless of the manufacturer of the liquid feeding pump. Even in a case where a plurality of types of liquid feeding pumps are used, it is possible to detect whether or not these liquid feeding pumps are in operation based on information from the same liquid gauge, so that a determination criteria for whether or not the liquid feeding pump is in operation can be made common, and the complicated work of setting a determination criterion for each liquid feeding pump is unnecessary.

Meanwhile, there are cases where a plurality of analysis devices are network-connected to a common data server, and the operating status of each analysis device on the network is managed through the data server. In such a case, even when the system of each analysis device has been activated, it is difficult to grasp via the data server whether or not the analysis device is actually performing an analysis operation.

As an example, in an analysis device that performs analysis while feeding a mobile phase, such as a liquid chromatograph, even when the system of the analysis device has been activated, the analysis device is not necessarily performing the analysis operation. It is nevertheless impossible to grasp whether or not the analysis device is actually performing the analysis operation by monitoring only whether or not the system of the analysis device has been activated. However, the analysis device such as the liquid chromatograph can determine that the analysis device is certainly in operation so long as the liquid feeding pump is in operation. Therefore, the use of the information of the liquid feeding pump operation monitor described above makes it possible to grasp the operating status of the analysis device such as the liquid chromatograph.

EMBODIMENT OF THE INVENTION

Hereinafter, an embodiment of a liquid feeding pump operation monitor according to the present invention will be described with reference to the drawings.

Figure 1:
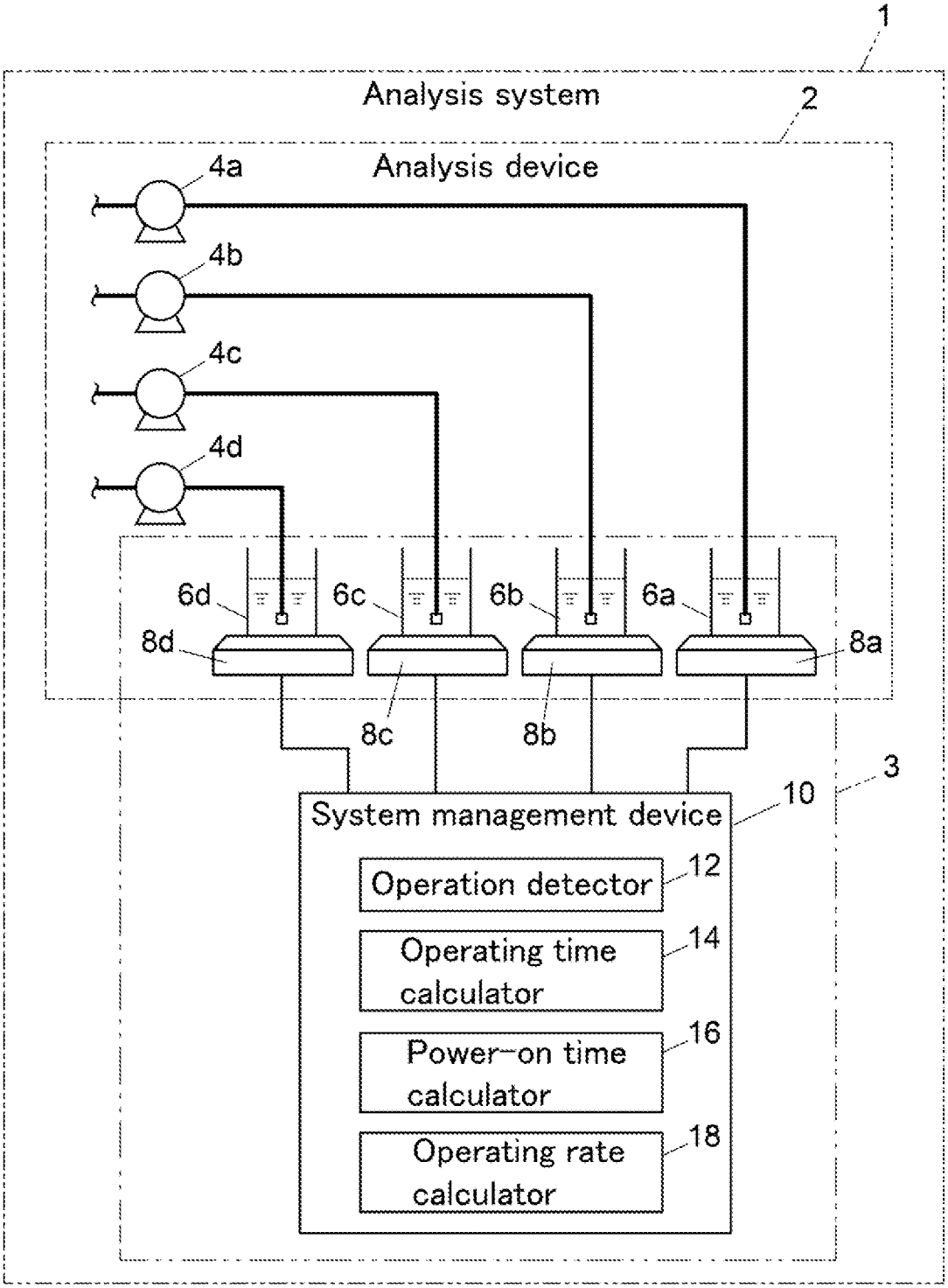
FIG. 1 is a schematic configuration diagram showing an embodiment of a liquid feeding pump operation monitor.

FIG. 1 shows an example of the configuration of a liquid feeding pump operation monitor incorporated in the analysis system 1. The analysis system 1 is made up of an analysis device 2 and a system management device 10. The system management device 10 is achieved by a dedicated computer or a general-purpose personal computer.

The analysis device 2 performs analysis while feeding a liquid such as a liquid chromatograph. The analysis device 2 of the present embodiment is configured to pump necessary liquids from containers 6*a* to 6*d* by using liquid feeding pumps 4*a* to 4*d*, and feed the liquid. The containers 6*a* to 6*d* contain liquids to be fed by the liquid feeding pumps 4*a* to 4*d*, respectively.

The analysis system 1 includes a liquid feeding pump operation monitor 3 for monitoring the operating statuses of the liquid feeding pumps 4*a* to 4*d*. The liquid feeding pump operation monitor 3 is achieved by liquid gauges 8*a* to 8*d* and the system management device 10. The liquid gauges 8*a* to 8*d* measure the remaining amounts of liquids to be fed by the liquid feeding pumps 4*a* to 4*d* stored in the containers 6*a* to 6*d*, respectively. In the present embodiment, electronic balances that measure the weights of the containers 6*a* to 6*d* are used as the liquid gauges 8*a* to 8*d*. However, the liquid gauges 8*a* to 8*d* can be achieved by contactless liquid-level sensors that measure liquid levels in the containers 6*a* to 6*d*.

Measurement data obtained by each of the liquid gauges 8*a* to 8*d* is taken into the system management device 10 at regular intervals. The system management device 10 is provided with an operation detector 12, an operating time calculator 14, a power-on time calculator 16, and an operating rate calculator 18. These are functions obtained by an arithmetic element, such as a microcomputer, running a program.

The operation detector 12 is configured to detect the operations of the liquid feeding pumps 6*a* to 6*d*, by which liquids stored in the containers 6*a* to 6*d* are to be fed, based on the measured values of the liquid gauges 8*a* to 8*d* when the remaining amounts of the liquids reduce. The system management device 10 is configured in such a way that the liquid feeding pumps 4*a* to 4*d* and the containers 6*a* to 6*d* are associated with each other, and the operation of each liquid feeding pump 4*a* to 4*d* is detected based on a changing of the remaining amount of the liquid stored in each of the containers 6*a* to 6*d*. It can be determined whether or not the remaining amount of the liquid stored in each of the containers 6*a* to 6*d* has reduced, for example, by calculating a changing rate in the remaining amount of each liquid at regular time intervals, and determining whether or not the changing rate is a predetermined value (0 or less).

Figure 3:
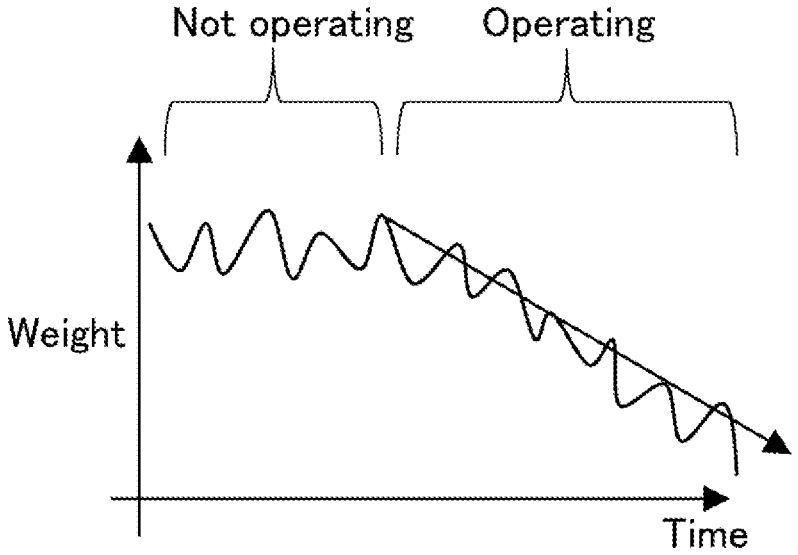
FIG. 3 is a graph showing an example of a signal waveform of a liquid gauge in the same embodiment.

In this case, signal values output from the liquid gauges 8*a* to 8*d* contain noise as shown in FIG. 3, and hence, it is preferable to use values subjected to noise removal processing, such as averaging processing, for calculation of the changing rate. When the changing rate (slope) is equal to or less than a predetermined value, it can be determined that the liquid feeding pump, by which the liquid in the container is to be fed, is in operation.

The operating time calculator 14 is configured to calculate the operating time of each of the liquid feeding pumps 4*a* to 4*d*. The operating time of each of the liquid feeding pumps 4*a* to 4*d* is found by adding up the time during which the operation of each of the liquid feeding pumps 4*a* to 4*d* is being detected by the operation detector 12. That is, the operating time calculator 14 starts integration of the operating time when the changing rate in the measured value of the liquid gauge becomes a predetermined value or less, and stops the integration when the changing rate exceeds the predetermined value. By repeating this integration processing, the total operating time of each of the liquid feeding pumps 4*a* to 4*d* is calculated.

The power-on time calculator 18 is configured to calculate the power-on time of each of the liquid feeding pumps 4*a* to 4*d*. The power-on time of each of the liquid feeding pumps 4*a* to 4*d* may be found by adding up the time during which each of the liquid feeding pumps 4*a* to 4*d* is actually on. However, since the liquid feeding pumps 4*a* to 4*d* and the liquid gauges 8*a* to 8*d* are turned on at the same timing, the time during which the liquid gauges 8*a* to 8*d* are on may be integrated to calculate the power-on time of each of the liquid feeding pumps 4*a* to 4*d*.

The operating rate calculator 18 is configured to calculate the operating rate of each of the liquid feeding pumps 4*a* to 4*d* by using the operating time of each of the liquid feeding pumps 4*a* to 4*d* found by the operating time calculator 14 and the power-on time of each of the liquid feeding pumps 4*a* to 4*d* found by the power-on time calculator 18. Specifically, the operating rate of each of the liquid feeding pumps 4*a* to 4*d* can be found by the following equation:

$$\text{Operating rate (\%)} = (\text{Operating time}/\text{Power-on time}) \times 100$$

Note that the operating time, power-on time, and operating rate of each of the liquid feeding pumps 4*a* to 4*d* can be reset to 0 by the user at any time. The timing for resetting the operating time, power-on time, and operating rate of each of the liquid feeding pumps 4*a* to 4*d* to 0 is, for example, the timing before or after maintenance, such as replacement of the seal part of the liquid feeding pump, is performed. By resetting the operating time, power-on time, and operating rate of each of the liquid feeding pumps 4*a* to 4*d* to 0 at this timing, it is possible to monitor how long each of the liquid feeding pumps 4*a* to 4*d* has been operated since the previous maintenance and grasp the next maintenance time.

Figure 8:
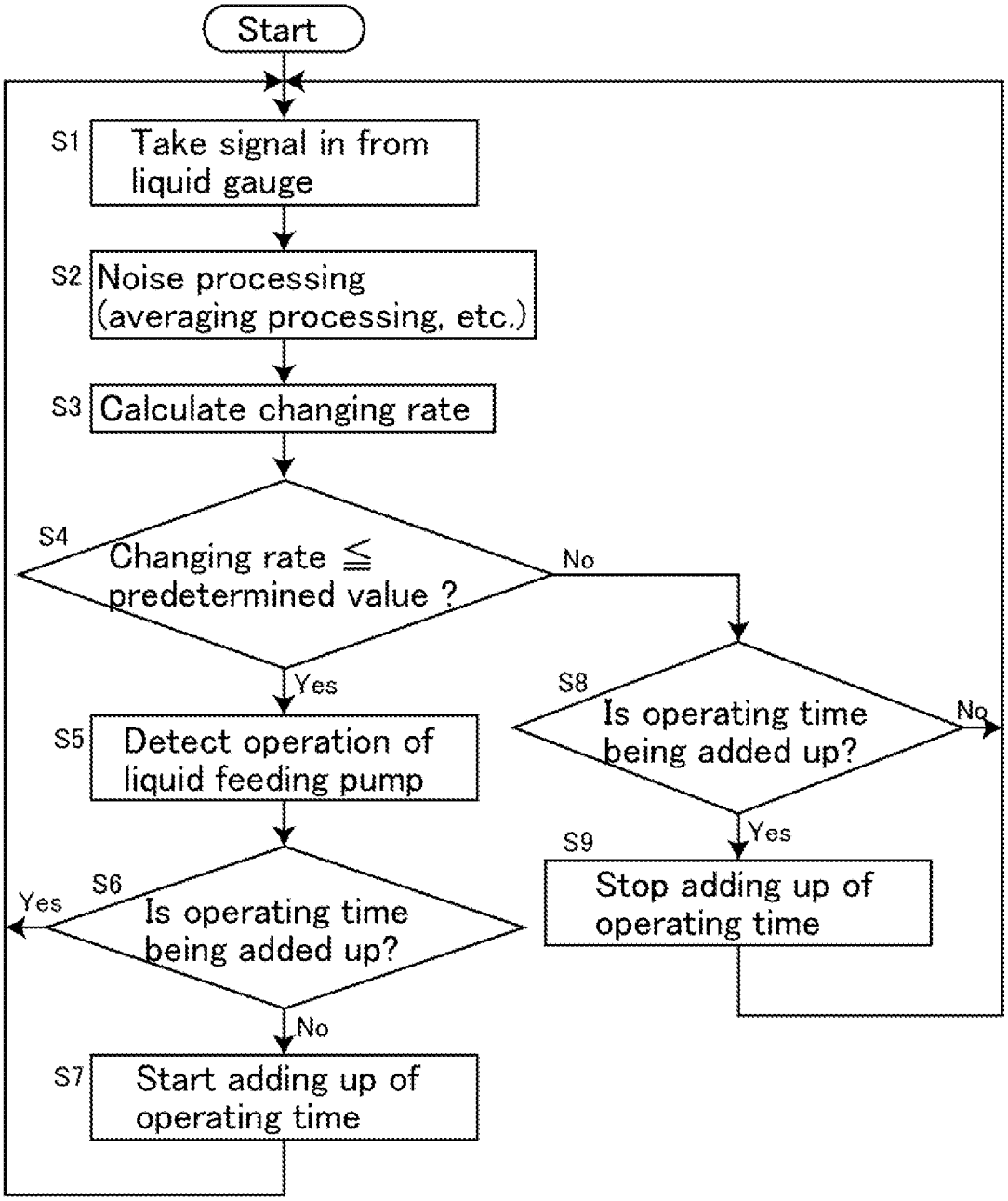
FIG. 8 is a flowchart showing an example of an operation for detecting the operation of the liquid feeding pump and an operation for integrating the operating time.

Here, operations performed by the operation detector 12 and the operating time calculator 14 will be described with reference to a flowchart of FIG. 8.

When signals from the liquid gauges 8*a* to 8*d* are taken into the system management device 10 (step S1), noise processing to remove noise, such as averaging processing, is performed in the system management device 10 (step S2). The operation detector 12 calculates a changing rate in each signal value from each of the liquid gauges 8*a* to 8*d* by using the noise-processed signal (step S3) and compares each changing rate with a predetermined value 0) (step S4). When the found changing rate is equal to or less than the predetermined value, it is detected that the liquid feeding pump corresponding to the liquid gauge is in operation (step S5). When having not started integrating the operating time of the liquid feeding pump which has been detected to be in operation, the operating time calculator 14 starts integrating the operation time of the liquid feeding pump (steps S6, S7), and when having started integrating the operating time, the operating time calculator 14 continues the current integration (step S6).

Further, in a case where the found changing rate exceeds the predetermined value (step S4), when the operating time of the liquid feeding pump is being integrated, the operation detector 12 stops the integration (steps S8, S9).

Figure 4:
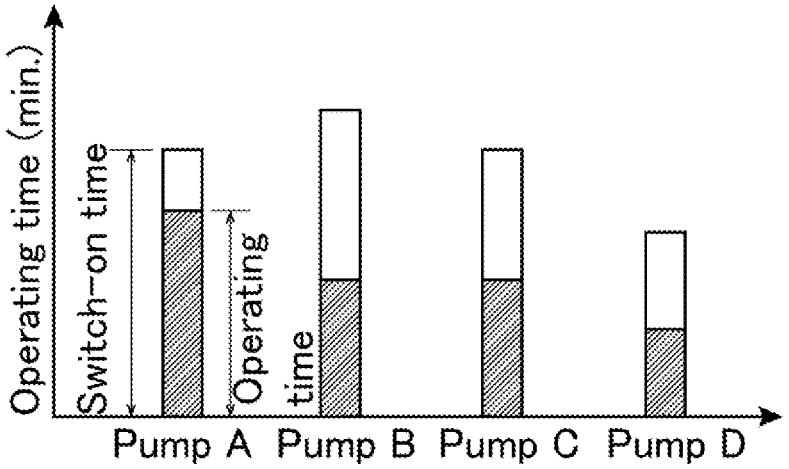
FIG. 4 is an example of operating time data found by the liquid feeding pump operation monitor of the same embodiment.
Figure 5:
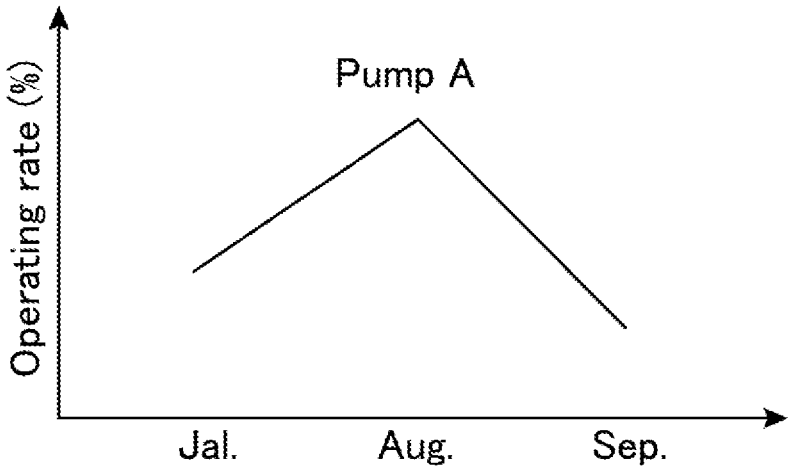
FIG. 5 is an example of data on transition of an operating rate of a specific liquid feeding pump, found by the liquid feeding pump operation monitor of the same embodiment.

With the function of the liquid feeding pump operation monitor 3 described above, it is possible to obtain data concerning the power-on time (switch-on time) and the operating time of each of the liquid feeding pumps 4*a* to 4*d* (denoted as pumps A to D in the figure) within a certain period as shown in FIG. 4, and data on the operating rate of a specific liquid feeding pump for each certain period (monthly in the figure) as shown in FIG. 5.

Figure 6:
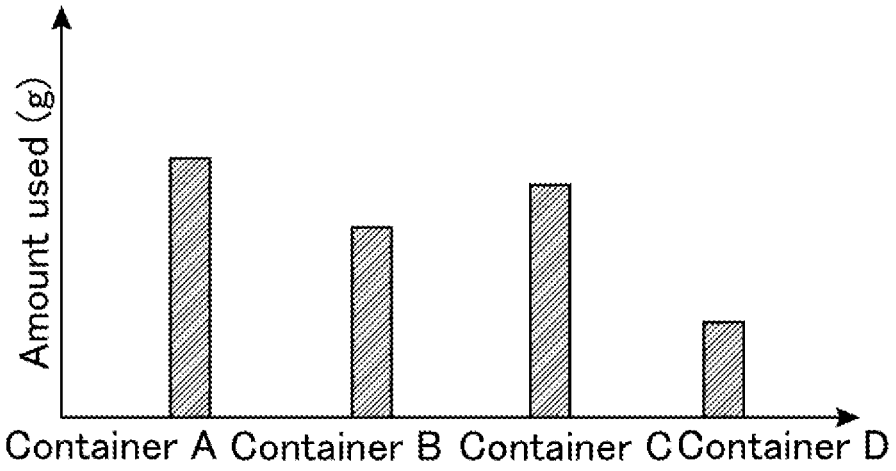
FIG. 6 is an example of data on a sample amount of each liquid, found using the liquid feeding pump operation monitor of the same embodiment.
Figure 7:
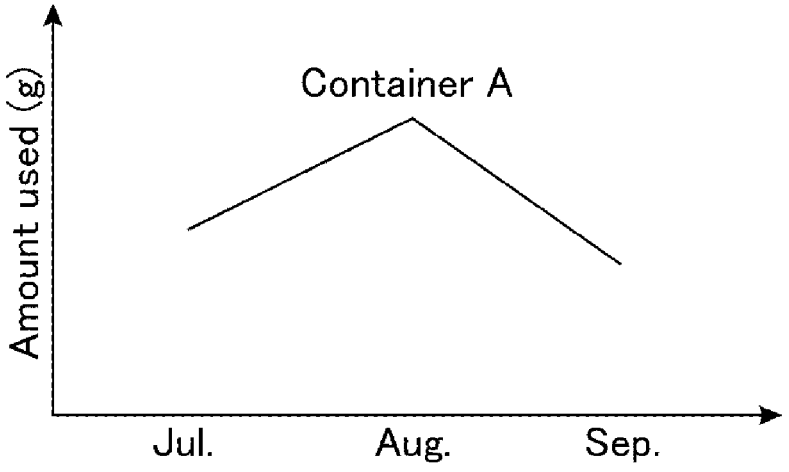
FIG. 7 is an example of data on transition of an amount of a specific liquid used, found by using the liquid feeding pump operation monitor of the same embodiment.

In addition, although it is not directly related to the operating statuses of the liquid feeding pumps 4*a* to 4*d*, integrating the amount of reduction in the liquid in each of the containers 6*a* to 6*d* based on the measured values of the liquid gauges 8*a* to 8*d* makes it possible to obtain data on the total amount of liquid used in each of the containers 6*a* to 6*d* within a certain period as shown in FIG. 6, and data on transition of the amount of a liquid in a specific container for each certain period (monthly in the figure) as shown in FIG. 7.

The user can access the data as described above through the system management device 10 or another terminal electrically connected to the system management device 10.

Figure 2:
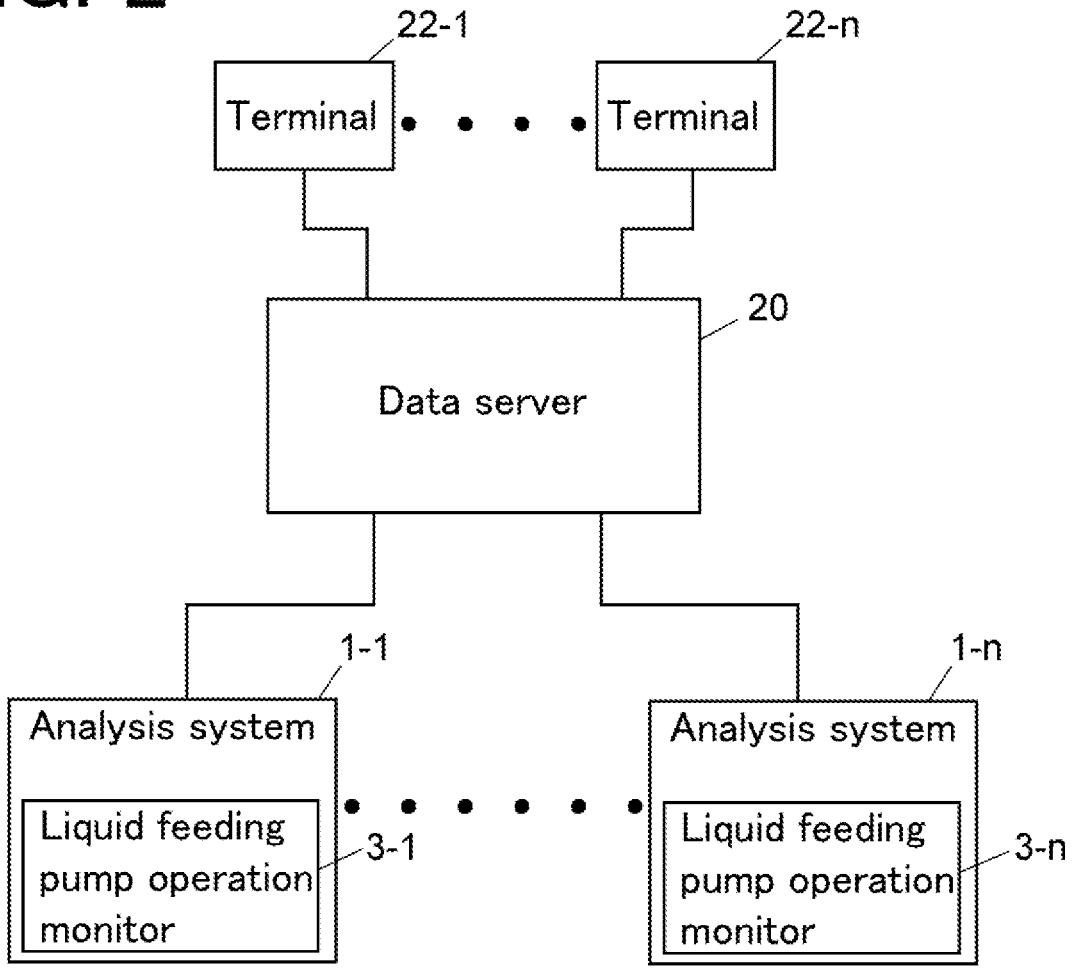
FIG. 2 is a block diagram schematically showing a network configuration of an analysis system.

In addition, as shown in FIG. 2, when a plurality of analysis systems 1-1 to 1-*n* are connected to a common data server 20 to construct a network, the data server 20 is preferably configured to collect data concerning the operating status of the liquid feeding pump in each of the analysis systems 1-1 to 1-*n*, obtained by each of liquid feeding pump operation monitors 3-1 to 3-*n* in the analysis systems 1-1 to 1-*n*. Then, the user can access the data on the operating status of the liquid feeding pump in each of the analysis systems 1-1 to 1-*n*, collected in the data server 20, through any of terminals 22-1 to 22-*n*.

As described above, in an analysis device that performs analysis while feeding a mobile phase like a liquid chromatograph, it can be determined that the analysis device is in operation when the liquid feeding pump is in operation, so that the user can grasp the actual operating status of each of the analysis systems 1-1 to 1-*n* based on the operating status of the liquid feeding pump in each of the analysis systems 1-1 to 1-*n* collected in the data server 20.

In the embodiment described above, the operation detector 12, the operating time calculator 14, the power-on time calculator 16, and the operating rate calculator 18 have been provided in the system management device 10, but the present invention is not limited to this, and some or all of these may be provided in the liquid gauges 8*a* to 8*d* and the data server 20.

DESCRIPTION OF REFERENCE SIGNS

1, 1-1 to 1-*n*: analysis system
2: analysis device
3, 3-1 to 3-*n*: liquid feeding pump operation monitor
4*a* to 4*d*: liquid feeding pump
6*a* to 6*d*: container
8*a* to 8*d*: liquid gauge
10: system management device
12: operation detector
14: operating time calculator
16: power-on time calculator
18: operating rate calculator
20: data server
22-1 to 22-*n*: terminal

The invention claimed is:

1. An analysis system comprising:

an analysis device that performs analysis using liquid flow, the analysis device including a liquid feeding pump for feeding liquid from a container to provide the liquid flow, the container containing a liquid for the analysis;

a liquid gauge that measures a remaining amount of the liquid in the container;

an operation detector configured to detect a reduction of the remaining amount, which is measured by the liquid gauge, of the liquid to be fed, and to detect an operation of the liquid feeding pump based on the detection of the reduction; and an operating time calculator configured to calculate an operating time of the liquid feeding pump by adding up a time during which the operation of the liquid feeding pump is detected by the operation detector.

2. The analysis system according to claim 1, further comprising:

a power-on time calculator configured to add up a time during which the liquid feeding pump is on; and an operating rate calculator configured to calculate an operating rate of the liquid feeding pump based on the operating time calculated by the operating time calculator and the power-on time calculated by the power-on time calculator.

3. The analysis system according to claim 1, wherein the operation detector is configured to calculate a changing rate of the remaining amount, which is measured by the liquid gauge, of the liquid to be fed, and to detect that the liquid feeding pump is in operation when the changing rate is equal to or less than a predetermined value.

4. The analysis system according to claim 3, wherein the operation detector is configured to perform a noise removal processing on the remaining amount, which is measured by the liquid gauge, of the liquid to be fed, before the changing rate is calculated.

5. The analysis system according to claim 1, wherein the liquid gauge measures a weight of a container in which the liquid to be fed is stored.

6. The analysis system according to claim 1, wherein the liquid gauge measures a liquid level of the liquid to be fed.

7. A network system comprising:

a data server to which the analysis system according to claim 1 is connected and in which information concerning an operating status of the liquid feeding pump, acquired by the analysis system, is collected; and a terminal connected to the data server in order to access the information concerning the operating status of the liquid feeding pump, collected in the data server.

8. The network system according to claim 7, wherein a plurality of analysis systems are connected to the data server, and the network system is configured to be able to access, from the terminal, information concerning an operating status of the liquid feeding pump in any of the analysis systems.

* * * * *